US006196083B1

(12) United States Patent
Pasko et al.

(10) Patent No.: US 6,196,083 B1
(45) Date of Patent: Mar. 6, 2001

(54) PIVOTING HANDLE ASSEMBLY HAVING WEIGHT COMPENSATION

(75) Inventors: Mark E. Pasko, Waterford; Gino D'Alessandro, Washington Township, both of MI (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/118,330

(22) Filed: Jul. 17, 1998

(51) Int. Cl.[7] ..... G05G 1/04
(52) U.S. Cl. ..... 74/518; 74/517
(58) Field of Search ..... 74/469, 490.13, 74/519, 518, 517; 414/11, 10; 16/401, 332; 404/102; 116/56

(56) References Cited

U.S. PATENT DOCUMENTS

| | | | | |
|---|---|---|---|---|
| 264,389 | | 9/1882 | Wilhelm . | |
| 1,085,422 | * | 1/1914 | Hills | 16/401 X |
| 2,721,547 | * | 10/1955 | Pollock | 16/401 X |
| 2,972,259 | | 2/1961 | Favre | 74/97 |
| 3,020,778 | | 2/1962 | Davison | 74/489 |
| 3,375,723 | | 4/1968 | Wolf | 74/100 |
| 4,026,165 | | 5/1977 | Papp | 74/480 |
| 4,238,975 | | 12/1980 | Jones | 74/502 |
| 4,249,682 | * | 2/1981 | Yasue et al. | 81/124.2 X |
| 4,365,581 | * | 12/1982 | Margiloff | 116/56 |
| 4,656,780 | | 4/1987 | Miyauchi et al. | 49/348 |
| 4,673,311 | | 6/1987 | Whiteman, Jr. | 404/112 |

* cited by examiner

*Primary Examiner*—David A. Bucci
*Assistant Examiner*—Marcus Charles
(74) *Attorney, Agent, or Firm*—Oldham & Oldham Co.

(57) ABSTRACT

A pivoting handle assembly having weight compensation which is anticipated to be used in conjunction with parts, part handling fixtures and other materials to reduce the apparent weight of the pivoting handling assembly having weight compensation to an operator and thereby reduce operator fatigue. In particular, an elongated spring member is positioned in the interior of an elongated pivoting arm member to at least partially compensate for the apparent weight to an operator of the pivoting handle assembly having weigh compensation being supported, transported and/or positioned thereby. As elongated pivoting arm member is rotated in a first rotational direction, a chain is wrapped around the center diameter of a pivot portion between the elongated pivoting arm member and a stationary arm member and a pin is pulled to compensate for the change in length, thus compressing the elongated spring member. When the elongated spring member is compressed, it imposes a torque about the center diameter of the pivot portion of the stationary arm member. This applied torque tends to rotate the stationary arm member in a second rotational direction opposite to the first rotational direction and thereby reduces the apparent weight of the pivoting handle assembly having weight compensation to an operator.

20 Claims, 1 Drawing Sheet

PIVOTING HANDLE ASSEMBLY HAVING WEIGHT COMPENSATION

BACKGROUND AND SUMMARY OF THE INVENTION

The present invention relates generally to a pivoting handle assembly having weight compensation. More particularly, the present invention relates to a pivoting handle assembly having weight compensation which aids an operator by supporting the weight of the pivoting handle assembly having weight compensation, thereby reducing operator fatigue.

In many manufacturing and assembly operations, it is necessary for operators to support and maneuver relatively large and/or heavy handles which are part of material handling devices. For example, in motor vehicle assembly, it is often beneficial to have long handles on material handling devices used to, for example, assemble motor vehicle doors on motor vehicle frames. Such motor vehicle doors are relatively large and heavy. The long handles enable an operator to position the motor vehicle doors in a wider range of elevations without over-extending the operator. However, the long handles become heavy and burden the operator. This is particularly the case when operators work eight (8) hour shifts, or longer, for five (5), or more, days a week. Over time, operators often develop fatigue which can have a negative impact on productivity and, in many cases, operators develop back problems and/or other physical injuries and health problems as a result of supporting, transporting and/or positioning such relatively large and/or heavy handles. Such physical injuries and health problems result in work days being missed by the operators, greater than desired medical costs and decreased operator morale.

Several prior art handles have been used to assist operators in supporting, transporting and/or positioning relatively large and/or heavy parts in manufacturing and assembly operations. However, a limitation of many known prior art handles is that they are heavy. In many situations, such as assembling motor vehicle doors onto a motor vehicle frame, it is necessary to position and support the part to be assembled in rather precise alignment with other parts to obtain a high quality end product. Many prior art handles are awkward for the operator to support and hinder the operator's ability to consistently carry out manufacturing and assembly operations where relatively precise alignment is necessary and/or desired.

Accordingly, an object of the present invention is the provision of a pivoting handle assembly having weight compensation which reduces the apparent weight of the pivoting handle assembly to an operator.

Another object of the present invention is to provide a pivoting handle assembly having weight compensation which is economical to fabricate, maintain and use.

Yet another object of the present invention is to provide a pivoting handle assembly having weight compensation which aids operators in supporting, transporting and/or positioning parts, part handling fixtures and other materials during manufacturing and assembly operations.

These and other objects of the present invention are attained by the provision of a pivoting handle assembly having weight compensation which is anticipated to be used in conjunction with parts, part handling fixtures and other materials to reduce the apparent weight of the pivoting handle assembly having weight compensation to an operator and thereby reduce operator fatigue. In particular, an elongated spring member is positioned in the interior of an elongated pivoting arm member to at least partially compensate for the weight of the pivoting handle assembly having weight compensation that an operator must hold. A pin extends through the elongated spring member and has an internally threaded nut attached to one end thereof and is secured at the other end to one end of a chain by a master link. The chain is secured at its other end to a stationary arm member by a second master link. The elongated spring member is contained between two (2) screws on one end and the internally threaded nut on the other end. As elongated pivoting arm member is rotated in a first rotational direction, the chain is wrapped around the center diameter of a pivot portion of the stationary arm member and the pin is pulled to compensate for the change in length, thus compressing the elongated spring member. When the elongated spring member is compressed, it imposes a torque about the center diameter of the pivot portion of the stationary arm member. This applied torque tends to rotate the stationary arm member in a second rotational direction opposite to the first rotational direction and thereby reduces the apparent weight of the pivoting handle assembly to the operator. The internally threaded nut is preferably adjustable to compensate for varying weights of the pivoting handle assemblies having weight compensation, as well as for operator preferences, and a relatively long spring is preferably utilized to assist in maintaining the spring rate relatively constant over a wide range of positions.

Other advantages and novel features of the present invention will become apparent in the following detailed description of the invention when considered in conjunction with the accompanying drawings.

DETAILED DESCRIPTION OF THE DRAWINGS

Figure 1:
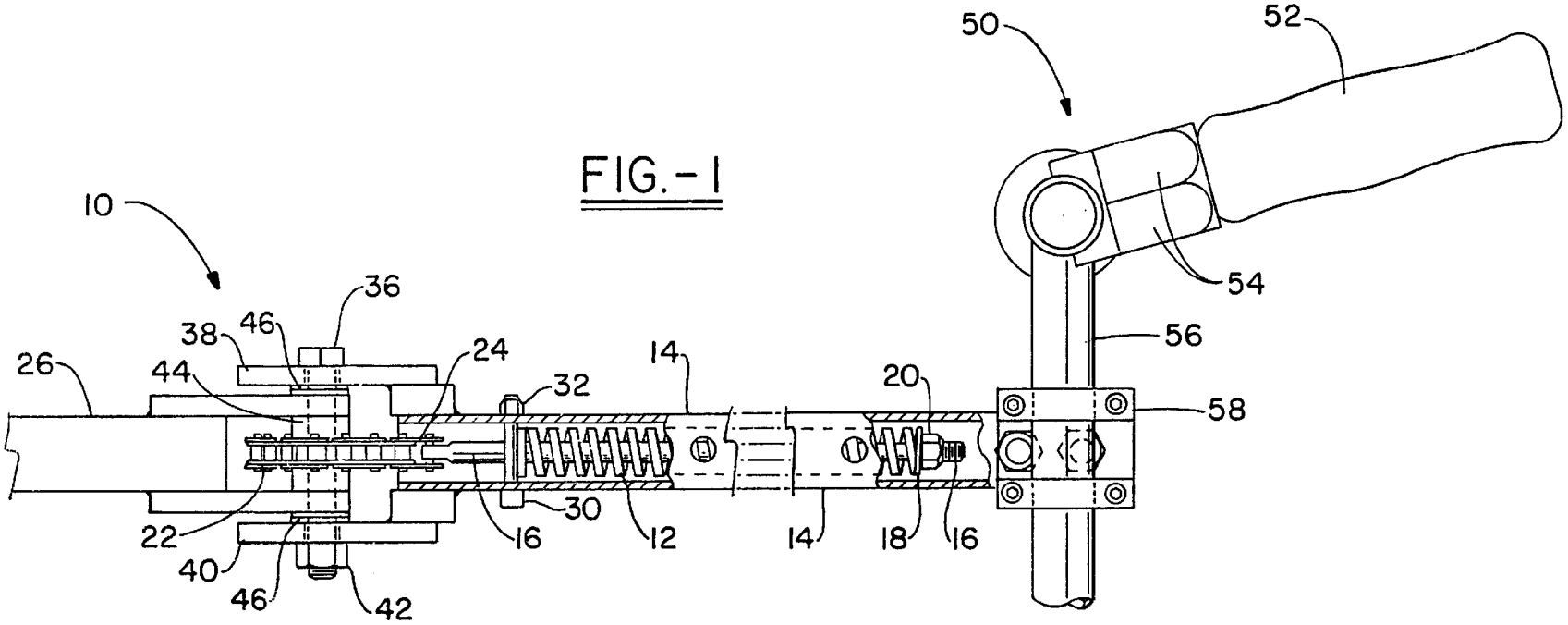
FIG. 1 is a top view partially broken away of a pivoting handle assembly having weight compensation in accordance with a preferred embodiment of the present invention.
Figure 2:
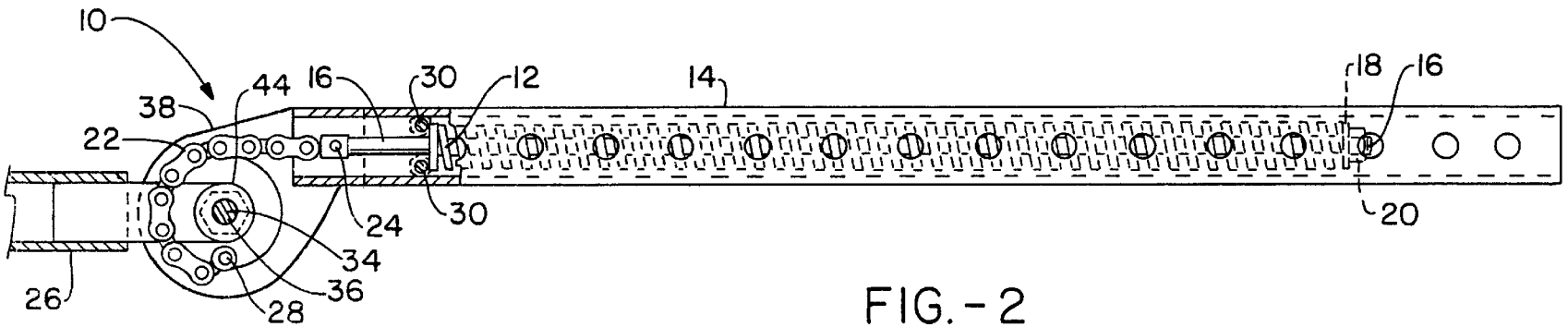
FIG. 2 is a side view partially broken away of the pivoting handle assembly having weight compensation in accordance with the preferred embodiment of the present invention shown in FIG. 1.

In the following detailed description of a preferred embodiment of the present invention, reference is made to the accompanying drawings which, in conjunction with this detailed description, illustrate and describe a preferred embodiment of a pivoting handle assembly having weight compensation in accordance with the present invention. Referring to FIGS. 1 and 2, a top view partially broken away and a side view partially broken away, respectively, of a pivoting handle assembly having weight compensation in accordance with a preferred embodiment of the present invention, generally identified by reference numeral 10, is shown. Pivoting handle assembly having weight compensation 10 is anticipated to be used in conjunction with parts, part handling fixtures and other materials to permit an operator to support, transport and/or position such parts, part handling fixtures and other materials during manufacturing and assembly operations and to reduce the apparent weight of pivoting handle assembly having weight compensation 10 to the operator and thereby reduce operator fatigue. Pivoting handle assembly having weight compensation 10 generally includes elongated spring member 12 which is preferably positioned in the interior of elongated pivoting arm member 14 to at least partially compensate for the apparent weight of pivoting handle assembly having weight compensation 10 to an operator.

Pivoting handle assembly having weight compensation 10 includes pin 16 which extends through elongated spring member 12 and preferably includes external threads over at least one end portion thereof. Washer 18 is placed over pin 16 and internally threaded nut 20 engages with the external threads of pin 16 to retain pin 16 in position relative to elongated spring member 12. The other end of pin 16 is secured to a first end of chain 22 by master link 24. The other end of chain 22 is secured to stationary arm member 26 by master link 28. Elongated spring member 12 is retained between two (2) screws 30 which are retained on elongated pivoting arm member 14 by two (2) internally threaded nuts 32. Handle assembly 50, such as a bicycle-type two (2) handle assembly having two (2) hand gripping handles 52 (only one of which is shown), is attached at or near the end of elongated pivoting arm member 14 distal from stationary arm member 26 to allow an operator to hold and control pivoting handle assembly having weight compensation 10. Handle assembly 50 also preferably includes either electrical or pneumatic controls 54 carried by cross bar member 56 which is mounted within trunnion 58 bolted to elongated pivoting arm member 14.

Thus, as elongated pivoting arm member 14 is rotated in a first rotational direction (clockwise as shown in FIG. 2), chain 22 is wrapped around center diameter of pivot portion 34 of stationary arm member 26 and pin 16 is pulled (to the left as shown in FIG. 2) to compensate for the change in length, thus compressing elongated spring member 12. When elongated spring member 12 is compressed, it imposes a torque about the center diameter of pivot portion 34 of stationary arm member 26. This applied torque tends to rotate elongated pivoting arm member 14 in a second rotational direction opposite to the first rotational direction (counterclockwise in FIG. 2) and thereby reduces the apparent weight of pivoting handle assembly having weight compensation 10 to an operator.

Elongated pivoting arm member 14 is preferably pivotally secured to stationary arm member 26 at the center diameter of pivot portion 34 by inserting shoulder screw 36 through two (2) substantially parallel outwardly extending flange portions 38 and 40 extending outwardly from elongated pivoting arm member 14 and shoulder screw 36 is retained in position by internally threaded nut 42. Bushing 44 and thrust waster 46 are positioned at the center diameter of pivot portion 34 to assist in pivotal movement between elongated pivoting arm member 14 and stationary arm member 26.

The position of pin 16 relative to elongated pivoting arm member 14 is preferably adjustable to compensate for varying weights of pivoting handle assembly having weight compensation 10, as well as for operator preferences, by adjusting washer 18 and internally threaded nut 20. In addition, elongated spring member 12 is a relatively long spring to assist in maintaining the spring rate at a relatively constant level over a wide range of positions.

In the preferred embodiment of pivoting handle assembly having weight compensation 10 shown in FIGS. 1 and 2, elongated pivoting arm member 14 is fabricated from a square steel tubular material with each side measuring approximately one (1) inch and includes a plurality of openings on each side throughout its length. Stationary arm member 26 is also preferably fabricated from a square steel tubular material with each side measuring approximately one (1) inch, although openings are preferably not present in stationary arm member 26. Pin 16 is preferably fabricated from an externally threaded steel bar material having a thread pattern which is compatible with internally threaded nut 20. Washer 18 is preferably a 0.281×0.625×0.065 inch plain washer and internally threaded nut 20 is preferably a ¼-20 lock nut. Chain 22 is preferably a #35 single strand roller chain having a total of approximately nine (9) links, including a master link at each end thereof. Screws 30 are preferably #10-24×1.25 inch long shoulder screws and internally threaded nuts 32 are preferably #10-24 lock nuts. Shoulder screw 36 is preferably a ⅜×2.25 inches long shoulder screw and internally threaded nut 42 is preferably a 5/16-18 inch lock nut. Bushing 44 is preferably a ½ inch outside diameter by ⅜ inch inside diameter by ½ inch long bushing #FL38-4 and thrust washer 46 is preferably a TW-37 thrust washer.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A pivoting handle assembly having weight compensation, comprising:

an elongated pivoting arm member having a first end and a second end, said first end being capable of being held by an operator;

a stationary arm member having a first end and a second end, said first end of said stationary arm member is pivotally attached to said second end of said elongated pivoting arm member and said second end of said stationary arm member being capable of supporting a part handling fixture and some other material to be supported, transported or positioned thereby; and an elongated spring member attached to said elongated pivoting arm member such that upon rotation of said elongated pivoting arm member in a first rotational direction, said elongated spring member is compressed and applies a torque in a second rotational direction opposite to said first rotational direction resulting in a reduction of the apparent weight of said pivoting handle assembly having weight compensation to an operator.

2. The pivoting handle assembly having weight compensation in accordance with claim 1, wherein said elongated spring member is positioned interior of said elongated pivoting arm member.

3. The pivoting handle assembly having weight compensation in accordance with claim 1, wherein said elongated spring member is positioned interior of said elongated pivoting arm member and is retained at one end by a pin extending through the inside of said elongated spring member and having a retention member at one end thereof.

4. The pivoting handle assembly having weight compensation in accordance with claim 1, wherein said elongated spring member is positioned interior of said elongated pivoting arm member and is retained at one end by a pin extending through the inside of said elongated spring member and having a retention member at one end thereof and said elongated spring member is retained at the other end by at least one retention member extending through said elongated pivoting arm member.

5. The pivoting handle assembly having weight compensation in accordance with claim 1, wherein said elongated pivoting arm member is pivotally attached to said stationary arm member by a chain having a master link at each end.

6. The pivoting handle assembly having weight compensation in accordance with claim 1, wherein said elongated pivoting arm member is pivotally attached to said stationary arm member by a chain having a master link at each end such that as said elongated pivoting arm member is rotated in a first rotational direction, said elongated spring member is compressed, thus imposing a torque on said stationary arm member.

7. The pivoting handle assembly having weight compensation in accordance with claim 1, wherein the position of a pin relative to said elongated pivoting arm member is adjustable to compensate for varying weights of said pivoting handle assembly having weight compensation and operator preferences.

8. The pivoting handle assembly having weight compensation in accordance with claim 1, wherein said elongated spring member is a relatively long spring to assist in maintaining the spring rate at a relatively constant level over a wide range of positions.

9. The pivoting handle assembly having weight compensation in accordance with claim 1, wherein said first end of said elongated pivoting arm member includes a bicycle-type handle assembly having two (2) hand gripping handles to allow an operator to hold and control said pivoting handle assembly having weight compensation.

10. The pivoting handle assembly having weight compensation in accordance with claim 2, wherein said elongated pivoting arm member is pivotally attached to said stationary arm member by a chain having a master link at each end.

11. The pivoting handle assembly having weight compensation in accordance with claim 2, wherein said elongated pivoting arm member is pivotally attached to said stationary arm member by a chain having a master link at each end such that as said elongated pivoting arm member is rotated in a first rotational direction, said elongated spring member is compressed, thus imposing a torque on said stationary arm member.

12. The pivoting handle assembly having weight compensation in accordance with claim 2, wherein the position of a pin relative to said elongated pivoting arm member is adjustable to compensate for varying weights of said pivoting handle assembly having weight compensation and operator preference.

13. The pivoting handle assembly having weight compensation in accordance with claim 2, wherein said elongated spring member is a relatively long spring to assist in maintaining the spring rate at a relatively constant level over a wide range of positions.

14. The pivoting handle assembly having weight compensation in accordance with claim 2, wherein said first end of said elongated pivoting arm member includes a bicycle-type handle assembly having two hand gripping handles to allow an operator to hold and control said pivoting handle assembly having weight compensation.

15. The pivoting handle assembly having weight compensation in accordance with claim 3, wherein said elongated pivoting arm member is pivotally attached to said stationary arm member by a chain having a master link at each end.

16. The pivoting handle assembly having weight compensation in accordance with claim 3, wherein said elongated pivoting arm member is pivotally attached to said stationary arm member by a chain having a master link at each end such that as said elongated pivoting arm member is rotated in a first rotational direction, said elongated spring member is compressed, thus imposing a torque on said stationary arm member.

17. The pivoting handle assembly having weight compensation in accordance with claim 3, wherein the position of said pin relative to said elongated pivoting arm member is adjustable to compensate for varying weights of said pivoting handle assembly having weight compensation and operator preference.

18. The pivoting handle assembly having weight compensation in accordance with claim 3, wherein said elongated spring member is a relatively long spring to assist in maintaining the spring rate at a relatively constant level over a wide range of positions.

19. The pivoting handle assembly having weight compensation in accordance with claim 3, wherein said first end of said elongated pivoting arm member includes a bicycle-type handle assembly having two hand gripping handles to allow an operator to hold and control said pivoting handle assembly having weight compensation.

20. The pivoting handle assembly having weight compensation in accordance with claim 4, wherein said elongated pivoting arm member is pivotally attached to said stationary arm member by a chain having a master link at each end.

* * * * *